United States Patent [19]

Rossi

[11] 4,090,842

[45] May 23, 1978

[54] SUPPORT FOR REDUCTION KILN GAS-ON SYSTEM INDEPENDENTLY OF FIRING HOOD

[75] Inventor: Eugene F. Rossi, Wauwatosa, Wis.

[73] Assignee: Allis-Chalmers Corporation, Milwaukee, Wis.

[21] Appl. No.: 753,014

[22] Filed: Dec. 21, 1976

[51] Int. Cl.[2] ..... F27B 7/24

[52] U.S. Cl. ..... 432/115; 432/117; 432/251; 137/615; 266/179; 285/134

[58] Field of Search ..... 432/105, 115, 251, 109, 432/117, 84, 116; 266/163, 173, 179; 285/134, 41; 137/594, 615; 34/242

[56] References Cited

U.S. PATENT DOCUMENTS

| | | | |
|---|---|---|---|
| 1,216,667 | 2/1917 | Downs | 432/109 |
| 1,797,130 | 3/1931 | Coley | 432/109 |
| 2,344,440 | 3/1944 | Lohse | 266/163 |
| 3,751,220 | 8/1973 | Rossi | 432/115 |

*Primary Examiner*—John J. Camby
*Assistant Examiner*—Larry I. Schwartz
*Attorney, Agent, or Firm*—Robert C. Jones

[57] ABSTRACT

The gas-on pipe is supported independently of the firing hood to provide for a greater length of the gas-on pipe thereby reducing the deflection stress in the gas-on pipe to acceptable values; adjustments to the end of the gas-on pipe is facilitated during kiln operation to obtain low stress values; the location of the end of the gas-on pipe is not affected by thermal expansion of the firing hood; and cooling process air leakage into the firing hood which causes overheating or process complications is eliminated.

1 Claim, 1 Drawing Figure

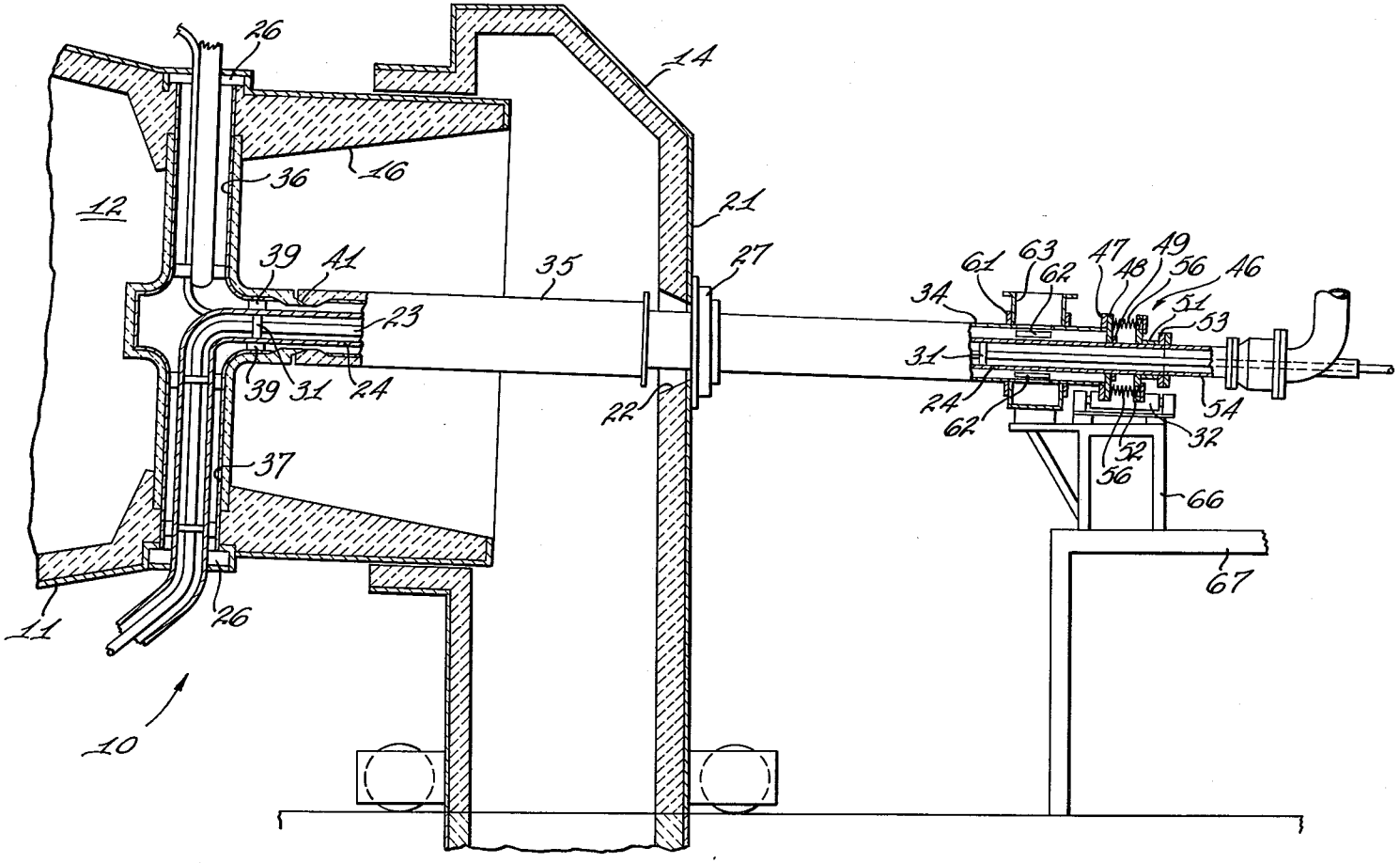
46
49
56
51
53
54
32
66
67
47
48
52
56
63
62
61
34
31
24
62
21
27
14
22
35
16
23
24
41
31
39
39
36
37
26
26
12
10
11

SUPPORT FOR REDUCTION KILN GAS-ON SYSTEM INDEPENDENTLY OF FIRING HOOD

BACKGROUND OF THE INVENTION

This invention relates to a reduction kiln gas-on system, and in particular to the assembly of the gas pipe and also of the cooling air pipe in conjunction with a means of supporting the system remote from the supported inner end of the gas pipe to thereby reduce the deflection stress in the gas pipe which occurs due to the misalignment between the rotary kiln and the stationary housing portions associated with the kiln and also eliminates cooling process air leakage into the combustion chamber of the kiln.

DESCRIPTION OF THE PRIOR ART

Rotary kilns for reducing iron ore to a lower state of oxidation having nozzles projecting through a kiln shell for injecting fuel and air into the kiln are disclosed in prior patents; for example U.S. Pat. Nos. 1,216,667 issued in 1917, 1,760,078 issued in 1930 and 2,344,440 issued in 1944. Such kilns disclose seals between nonrotating conduit structures and rotating conduit structures having a diameter larger than the diameter of the kiln. It has always been difficult to construct good seals of such larger diameter because thermal expansion is proportionately greater for larger sizes and it is more difficult to provide the dimension tolerances and surface finishes needed for effective seals. For conduits and nozzles delivering only air to the kiln the problem was not serious, as there is no danger involved if the seal leaks air externally of the kiln. The economic loss from leaking air is not great. However, leaks of combustible gases could involve both danger and significant economic loss, and leakage of cooling process air into the combustion chamber causes overheating and process complications.

Other ways have been disclosed by prior art patents to inject gaseous fuel into such a kiln without creating a need for such large diameter seals. U.S. Pat. No. 1,797,130 issued in 1931 accomplishes such fuel injection with a single tube extending along the central axis of the kiln and having nozzles which project radially outwardly from the tube. U.S. Pat. Nos. 2,848,198, 3,182,980 and 3,196,938 provide several axially extending fuel conduits inside the kiln shell. U.S. Pat. No. 3,011,722 discloses a double wall kiln with gaseous fuel being delivered to the space between the walls.

U.S. Pat. No. 3,751,220 discloses a fuel delivery system in which a tube is connected to a manifold which projects radially inwardly into the interior of the kiln and then axially outwardly through the hood to the exterior of the kiln for connection to the fuel supply. A cooling air pipe surrounds the portion of the fuel tube located in the interior of the kiln. Air is forced through the pipe to cool the fuel. A flexible ball joint is provided in the cooling pipe to compensate for any misalignment between the rotating axis of the kiln and the stationary axis of the hood. The kiln constructions disclosed in this group of patents all involve seals between stationary and rotating fuel delivery conduits having a diameter smaller than the outer diameter of the kiln but all these constructions have disadvantages, such as: inadequate space for retraction of a housing such as a firing hood; the cooling air box is on the housing; and, also, the length of the gas pipe is of limited length which increases deflection stresses. Further, processing and cooling air leakage into the combustion chamber which causes overheating or process complications is more difficult to prevent.

To overcome these shortcomings, it is known in the prior art to provide a fluid delivery system for a rotary kiln in which fluids from stationary sources of supply are delivered through tubing to conduit mounted on the outer surface of the kiln shell with the tubing extending through cooled piping which extends axially a short distance through the interior of the kiln. This arrangement permits a small diameter flexible seal to be used between the pipes and a housing such as a firing hood and at the same time locates most of the operating conduit externally of the kiln for easy inspection while the kiln is operating.

However, it is known that kilns will not continue to rotate about their geometric axis. Therefore, misalignment occurs between the kiln and the stationary hood inducing excessive bending stresses in that portion of the piping which extends along the axes of the rotating kiln and stationary hood. To overcome these bending stresses, it is known in the prior art to include a bellows connection between portions of the piping. The bellows have not been satisfactory because they rupture at an unreasonably early age.

It is, therefore, the intention and general object of this invention to provide a fluid delivery system for a rotary kiln in which fluid from stationary sources of supply are delivered through tubing through the housing such as a firing and thence to a connected conduit mounted on the outer surface of the kiln shell with the tubing extending through a cooled piping having a flexible ball pipe joint. The flexible ball pipe joint will permit angular motion of pipe sections relative to each other so as to compensate for misalignment between the rotating kiln and associated stationary portions.

BRIEF DESCRIPTION OF THE DRAWINGS

FIG. 1 is an enlarged fragmentary view partly in section and partly in elevation on the discharge end of a rotary kiln in which the present invention is incorporated.

DESCRIPTION OF THE PREFERRED EMBODIMENT

Referring to FIG. 1, a rotary kiln 10 is shown having a cylindrical shell 11 supported in any well known conventional manner (not shown) to rotate about a central axis. The shell 11 is lined with a refractory material and provided with a plurality of nozzles (not shown) axially and circumferentially spaced about the surface of the kiln. The nozzles extend through the kiln shell 11 and are open to the interior or combustion chamber 12 defined by the kiln shell to provide access for fuel and air into the connective chamber.

A housing or, as depicted in the drawing, a firing hood 14 is mounted about the discharge end of the kiln shell. In this manner the discharge opening 16 of the kiln 10 communicates with the interior of the firing hood 14. The mating relationship between the discharge end of the kiln 10 and the firing hood 14 is such as to provide for rotation of the kiln relative to the hood.

A rear wall 21 of the hood 14 is provided with an opening 22 which is in alignment with the axis of the kiln. Fluid delivery tubing in the form of an oil tube 23 and a gas tube 24 extend through the opening 22 into the combustion chamber 12 of the kiln; the opening 22 being sealed by a floating type seal 27. The tubing 23 and 24 are then bent to extend radially outwardly through an opening 26 provided in the kiln shell. The tubing is connected by means of a manifold (not shown) to fuel conduit (not shown) supported on the exterior of the kiln for rotation therewith. The fuel conduit is then connected to the fuel nozzles.

In the particular embodiment of the invention shown herein, for purposes of illustration, the fuel tube 24 is for gas and the tube 23 is an auxiliary fuel tube for oil.

As shown, auxiliary fuel tube 23 is supported within the gas or main fuel tube 24 in any conventional manner such as by spacers 31. Each of these tubes must rotate with the kiln shell 11, and therefore a sealing means between the stationary firing hood and the rotating tubes must be provided. Since the particular construction of this sealing means is not a portion of this invention, it is not shown herein. However, an example of an acceptable type of sealing means is a floating type of seal which permits of relative radial movement between two interacting components.

The gas tube 24 is supported on a pair of spaced-apart elongated rollers 32, one of which is shown, which supports the extending end of the gas tube and permits rotation thereof with the kiln. Since the auxiliary tube 23 is supported within the gas tube 24, it rotates with the gas tube.

An air cooling pipe 34 surrounds the tubing 23 and 24 and extends through the opening 22 in the rear wall of the hood 14 to the interior of the combustion chamber 12. The cooling pipe 34 has radially extending portions 36 and 37 which extend through the openings 26 through the kiln shell. The air cooling pipe 34 provides cooling air to the exterior of the kiln shell. The cooling air flows about the fuel tubes thereby cooling these tubes and the fuel therein as they pass through the combustion chamber of the kiln. It will be understood that within the combustion chamber 12 the cooling pipe 34 is surrounded by a refractory pipe 35 to afford protection from the heat of the combustion chamber.

Inherently kilns do not rotate on their geometric center and, therefore, misalignment will occur between the opening 22 and the rear wall of the firing hood 14 and the rotating axis of the kiln. Since the oil pipe 23 is relatively small in diameter, it is flexible and can bend to allow for misalignment. However, the relatively larger diameter gas pipe 24 might fracture if excessive misalignment should occur. To overcome this possibility, the pipe 24 extends rearwardly of a forward or inner support 39 a distance which locates the end of the pipe 24 remote from the forward support 39. This elongation of the pipe 24 serves to reduce deflection stress in the pipe to an acceptable value.

The external end of the elongated pipe 34, as previously mentioned, is rotatably supported on the spaced-apart rollers 32 which, in turn, are carried on a supporting structure 66 carried on a platform 67. The inner end of the pipe 34 is supported so as to provide adequate protection against fracturing of the pipe if excessive misalignment should occur, by means of a flexible ball joint 41 which may be of any suitable type such as that disclosed in U.S. Pat. No. 3,751,220.

Since the cooling pipe 34 and the kiln 11 are subject to expansion and contraction, a resilient compensating means 46 is provided. As shown, the end of the cooling pipe 34 is provided with a radial flange 47 that receives a spring plate 48. The spring plate 48 surrounds the gas tube or pipe 24 and has a seal 49 that effectively prevents air leakage from the end of the cooling pipe 34. A double flanged sleeve 51 is mounted about the gas tube 24 in spaced-apart relationship with respect to the spring plate end of the tube. As viewed in the drawing, the left-hand flange 52 has a diameter which is the same as the diameter of the flange 48. The smaller diameter flange portion 53 serves as a coupling means by which the tube 24 is coupled to a tube extension portion 54. Acting between the spring plate 48 and the flange 52 are a plurality of compression springs 56 which are spaced equidistance apart around the axis of the tube 24. The springs 56 serve to maintain the tube 24 in leftward position to maintain the flexible ball joint 41 closed and to compensate for any contraction or expansion that may occur. Thus, the pipe 24 is supported externally of the kiln by means of the flange 52 which rides on the rollers 32. The air cooler pipe 34 is supported externally of the kiln by the spring plate 48 which likewise rides on the rollers 32.

To supply air to the cooling pipe 34, there is provided a manifold 61 through which the pipe 34 extends. Equally spaced about the pipe 34 are a plurality of ports 62 through which air from the manifold passes into the pipe. The manifold 61 has an inlet 63 which receives air delivery from a source such as a compressor (not shown). Thus, with the cooling air manifold 61 located apart from the hood 14, there is no possibility of high pressure air leaking into the kiln combustion chamber 12 through the opening 22. This relieves the kiln system from process complications and overheating.

The positioning of the cooling air mainfold 61 and the compensating means 46 remote from the hood 14 simplifies retraction of the hood 14 from the kiln end. In this respect, all that is necessary is move the hood into the clear space provided between the hood and the support means 36. With the arrangement shown, there is no need to dismantle the manifold 61 or the compensating means 46. It is also true that the arrangement herein shown provides a clearance around the hood facilitating access and observation into the kiln. It is also true that the exterior end of the gas-on pipe 23 is accessible and adjustment thereto can be readily made during kiln operation to achieve low stress values. The construction and arrangement of the support 66 is simplified and in the open, thereby facilitating maintenance.

From the foregoing description, it can be seen that an improved arrangement of a fluid delivery system for a rotary kiln has been provided which facilitates and improves kiln operation and is far superior from a safety standpoint for the operating personnel in that components that may require inspection and maintenance during kiln operation are remote from high temperature areas.

The embodiments of the invention in which an exclusive property or privilege is claimed are defined as follows:

1. In a fluid delivery system for an axial end of a rotary kiln having a housing surrounding the end;

a cooling air pipe extending into the kiln through the housing which surrounds the end thereof;

sealing means sealing the space between the cooling air pipe and the opening in the housing through which said cooling air pipe extends to prevent the uncontrolled entry of air into said kiln;

at least one fuel pipe within said cooling air pipe extending into the kiln;

means supporting the inner end of said fuel pipe within said cooling air pipe;

rotatable support means for rotatably supporting the external end of said cooling air pipe and said fuel pipe positioned remote from the housing to provide space for the housing as it is moved away from the kiln said rotatable means including spring biasing means for continuously urging said cooling air pipe inwardly into the kiln and operating to provide a reactive force for said spring biasing means;

a cooling air manifold surrounding the external end of said cooling air pipe;

at least one port in said cooling air pipe in position within said manifold to permit entry of cooling air from said manifold into the interior of said cooling air pipe;

a common carrying structure located remote from the end of said housing for operatively carrying said cooling air manifold and said rotatable support in axially spaced-apart relationship;

a fuel pipe within said cooling air pipe and extending outwardly of the external end of said cooling pipe; and, a seal operable to seal the external end of said cooling air pipe from which said fuel pipe extends to prevent leakage of cooling air therefrom.

* * * * *